United States Patent [19]

Moltrasio et al.

[11] Patent Number: 4,516,762

[45] Date of Patent: May 14, 1985

[54] SYSTEM FOR PICKING UP AND SEPARATING BAGS FROM A PACK TO BE APPLIED TO AUTOMATIC BAG INSERTING APPARATUS

[75] Inventors: Mario Moltrasio; Vincenzo Perrucchini, both of Bergamo, Italy

[73] Assignee: Car-ventomatic S.p.A., Bergamo, Italy

[21] Appl. No.: 399,908

[22] Filed: Jul. 19, 1982

[30] Foreign Application Priority Data

Feb. 12, 1982 [IT] Italy ..... 19630 A/82

[51] Int. Cl.[3] ..... B65H 5/08

[52] U.S. Cl. ..... 271/11; 53/570; 271/18.3; 271/106; 414/121

[58] Field of Search ..... 271/20, 18.3, 19, 24, 271/25, 10, 11, 106; 414/114, 121; 53/570, 571

[56] References Cited

U.S. PATENT DOCUMENTS

| | | | |
|---|---|---|---|
| 326,124 | 9/1885 | Kneeland | 271/20 |
| 3,031,187 | 4/1962 | Sano et al. | 271/19 |
| 4,439,097 | 3/1984 | Mebus | 271/14 |

OTHER PUBLICATIONS

Western Electric Technical Digest No. 26, *Feed Mechanism for Printed Circuit Boards,* T. L. Aycock, J. C. Hetherington, Apr. 1972, pp. 3 and 4.

*Primary Examiner*—Bruce H. Stoner, Jr.

*Assistant Examiner*—John A. Carroll

*Attorney, Agent, or Firm*—Parmelee, Bollinger & Bramblett

[57] ABSTRACT

The invention relates to a system for feeding single bags to automatic bag inserting apparatuses, picking them up and also unsticking the bag being picked up from the underlying ones, in case they are glued to one another because of glue drops during the bag manufacture. The system substantially comprises (see FIG. 3) three units: a first unit provided with suction cups, picking up the bag at its transversal middle portion, where accidental adhesion of bags cannot happen, and lifting it to allow that two unsticking units, including bars being inserted under the bag and unsticking it from the underlying one with a spreading action, are inserted between said bag being picked up and the underlying one. One of the two units is also provided with pincers blocking the bag edges on the open unsticking arms and, in the return stroke of the unit to the starting position, transferring it on to the feeding device of the bag inserting apparatus. The other unsticking unit is so arranged that the two unsticking bars, in addition to the spreading action, are lowered so as to press the underlying bags so as to hold them down during the stage of bag picking by said pincers of the first unsticking unit, so that, if the unsticking was not complete, the underlying bags are kept blocked down and the bag being picked up is stripped and finally separated from the others.

3 Claims, 6 Drawing Figures

SYSTEM FOR PICKING UP AND SEPARATING BAGS FROM A PACK TO BE APPLIED TO AUTOMATIC BAG INSERTING APPARATUS

FIELD OF THE INVENTION

The present invention relates to a system for picking up and separating single bags from a pack, to be applied to apparatus for the automatic insertion of valved bags on bag-filling machines.

BACKGROUND OF THE INVENTION

In the field of automatic bag filling with materials or goods in granular or powder form, the use of apparatuses for the automatic insertion of bags is becoming more and more widespread. In such an apparatus a valved bag is picked up from a pack and is then handled by devices adapted to open the valve and insert it on the nozzle of the bag filling machine, which is an operation that was carried out manually until recent times. The valved bags used may be made of paper or plastic material.

In order to pick up single bags the bag inserting apparatus is generally provided with suction cup devices which are applied on a pack of bags, adhere to the uppermost bag because of the vacuum generated in the suction cups and transfer it, one at a time, to the other devices of the apparatus which open the bag valve and insert it on the nozzle of the bag filling machine by means of several devices. Valved bags and automatic bag inserting apparatus are disclosed in U.S. Pat. No. 4,141,392 to Moltrasio, to which reference may be had for a detailed description.

Such a process of picking up bags is wholly efficient if the stacked bags are only laying on one another. However it happens more and more frequently that bags are often glued to one another, because the bags are in turn manufactured automatically and are stacked when the glue joining the various parts (generally the bottom part and the top part provided with the valve) is not completely dried. Consequently, when the first bag of the pack is picked up, it drags the underlying bag and sometimes more than one bag. In such case either two or more bags are delivered together to the bag inserting apparatus, causing it to jam and requiring intervention of the operator, resulting in clear waste of time and loss of production. When several bags are stuck together, the suction cups are not able to raise them and there is a need for a manual intervention and breakdown of the operative cycle.

It has to be noted that in some bag inserting apparatus the pick-up rate is over 2,000 bags per hour, so that the above mentioned manual interventions affect severely the output. There is consequently the problem of separating the bags stuck together before they are delivered to the apparatus and therefore the need that the feeding device of the bag inserting apparatus is not limited to the mere pick up of the bag, but is also able to separate the bags which are stuck together, so as to always deliver single bags to the bag inserting apparatus.

SUMMARY OF THE INVENTION

The object of the present invention is to solve the problem of separating the bags stuck together. This problem is solved according to the present invention by a system of simple construction and reliable operation, adapted to always deliver single bags to the bag inserting apparatus, even if they are glued together. The invention comprises a device for transversally lifting the first bag of the pack at a central location, where the bag can never be glued to the underlying one. Devices are inserted under the top bag to unstick the bag from the bag below it and to sequentially separate and transfer all bags in the pack, one by one, to the feeding means of a bag insertion machine.

BRIEF DESCRIPTION OF THE DRAWINGS

The invention will be better understood from the description of the embodiment, given as a non limiting example only, illustrated in the accompanying drawings, in which.

DETAILED DESCRIPTION OF THE PREFERRED EMBODIMENT

Figure 2:
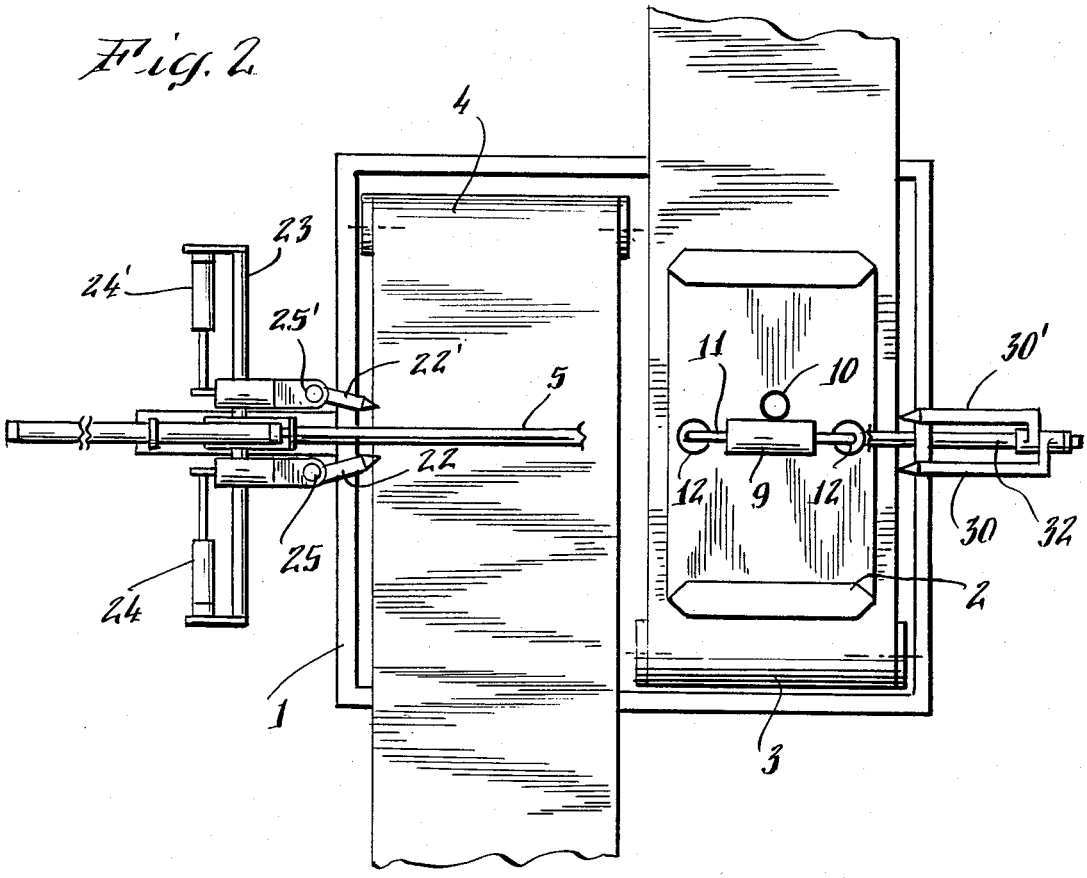
FIG. 2 is a top plan view of the same system also in the inoperative stage.

With reference now to FIGS. 1–5, the system according to the present invention comprises a structure 1 adapted to connect and support the various operative members or units of the apparatus to which it is joined, namely a device for feeding packs of bags 2, for instance a conveyor belt 3, and a device for transferring the single picked up bags to the bag inserting apparatus, for instance another conveyor belt 4.

On a guide 5 extending along the longitudinal middle portion of the system, at which the transversal middle part of the pack of bags is placed, a bag lifting device 6 is mounted in a fixed position while a first unsticking and transfer device 7 is sliding on said guide 5. A second unsticking device 8 is mounted on the structure, at the opposite side with respect to the device 7, said second device 8 being also adapted to hold down the underlying bags during the step of unsticking the uppermost bag.

The bag lifting device 6 comprises a piston 10 adapted to act in a vertical direction, having a transversal support 11 applied on its reciprocating rod, suction cups 12 of known type and of a number sufficient to allow picking up and lifting of the bag, being mounted on the transversal support 11 together with a pusher 13 fixed to a vertically sliding rod and held down by a spring. The pusher 13 acts on a plane which is lower than the operative plane of the suction cups 12 and has the function to press on the bag 2 by means of its spring 14, on the central part of said bag during lifting of the lateral edges thereof by the suction cups 12, so that the bag 2 takes approximately the position of FIG. 3, in order to foster separation of the underlying bag and to avoid that the same is lifted by adhesion.

Figure 1:
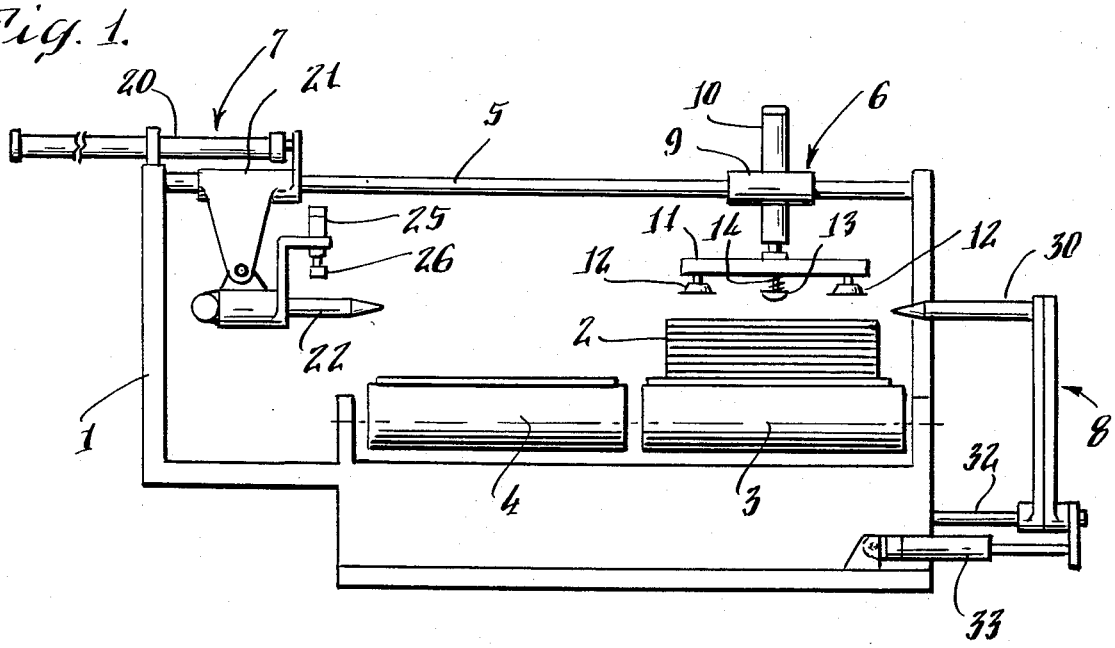
FIG. 1 is a lateral view of the system according to the present invention in the inoperative stage.
Figure 4:
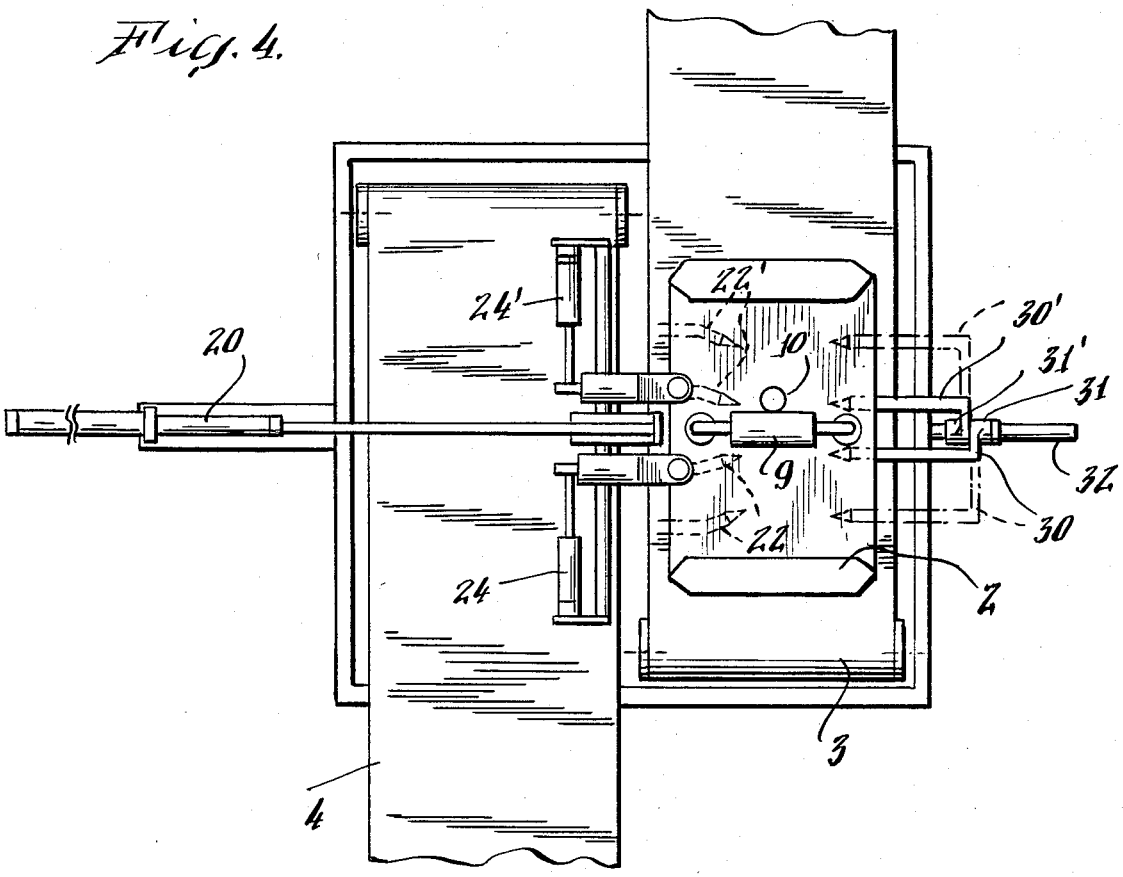
FIG. 4 is a top plan view of the system in operation, shown in two different conditions.
Figure 3:
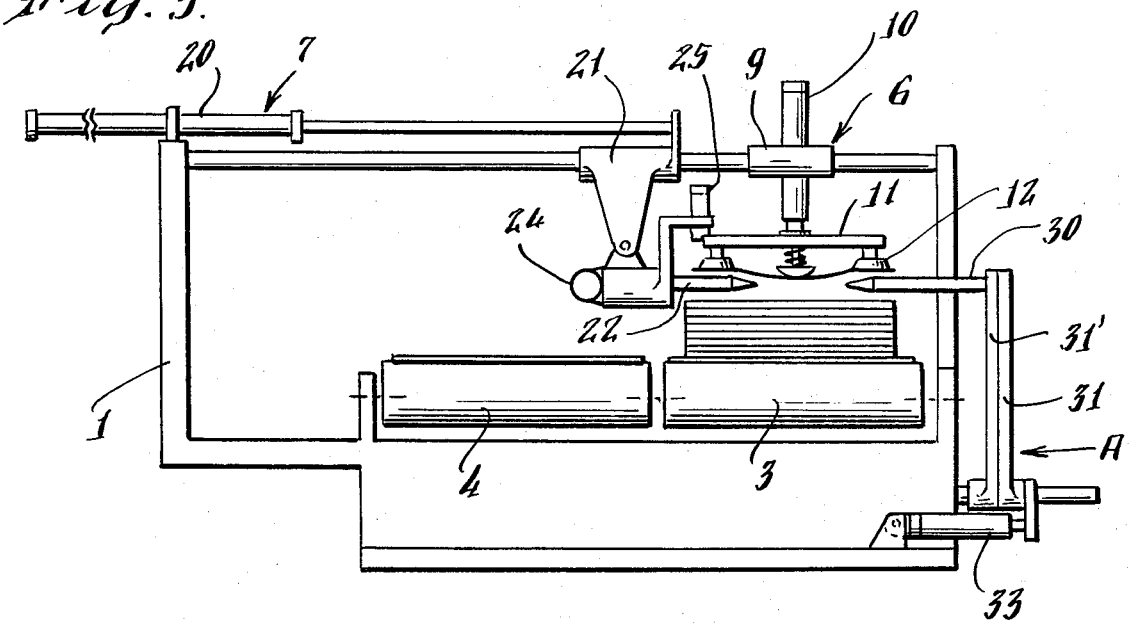
FIG. 3 is a lateral view of the system in the operative stage.

The first unsticking and transferring device 7 comprises the body 21 adapted to slide horizontally on the guide 5 and on which all the other members of the unit are mounted, namely: piston 20 causing the horizontal movement of the body 21 along the guide 5, bringing the device from the inoperative position of FIGS. 1 and 2 to the operative position of FIGS. 3 and 4; two unsticking bars 22 and 22' arranged so as to slide transversally on the bar 23 and actuated by pistons 24 and 24' respectively, so that they may assume the two positions shown in FIG. 4, i.e. close inserting position and open unsticking position; and, pistons 25 and 25' provided on their movable rod with pads 26 and 26' adapted to pinch the edges of bag 2 against the bars 22 and 22' so as to move said bag from the position laid on the conveyor belt 3 onto the conveyor belt 4 for delivery to the bag inserting apparatus, at the same time causing its final separation with a stripping action.

Figure 5:
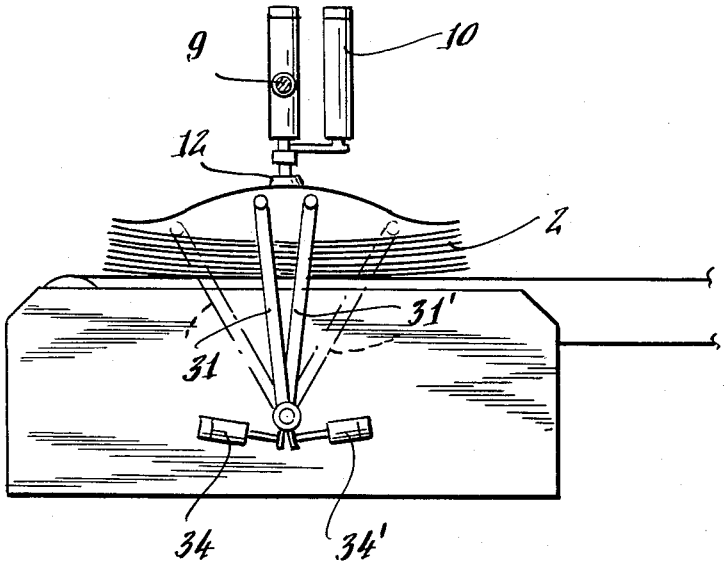
FIG. 5 is an end view of the system in operation, as seen from the arrow A of FIG. 3.

The second unsticking device 8, as shown more particularly also in FIG. 5, comprises two unsticking bars 30 and 30', mounted on arms 31 and 31' sliding longitudinally on guide 32 by means of piston 33, said arms 31 and 31' being pivoted at their foot on said guide 32 and being able to rotate around it by means of pistons 34 and 34'. During the opening stage the two bars 30 and 30', besides spreading, are also pressing the underlying bags, so as to avoid that they are entrained during the step of unsticking and final separation of the bag pinched by the unit or device 7. The system is completed by hoses connected to pneumatic or hydraulic means for actuating the pistons of the various elements. Hoses connecting the system to a vacuum source and means for controlling and synchronizing movements are conventional and well known to the art and therefore have not been described or illustrated in detail.

OPERATION

The operation of the system according to the present invention is as follows: the packs of bags 2 are sequentially fed on the conveyor belt 3 and positioned under the device 6, so that the pack of bags is placed with its transversal central axis approximately at the guide 5.

The conveyor belt 3 is stationary until all the bags of a pack are transferred one by one to the subsequent conveyor belt 4 which takes them individually to the bag inserting apparatus, and then upon a suitable control, feeds the system with another pack of bags 2.

Figure 6:
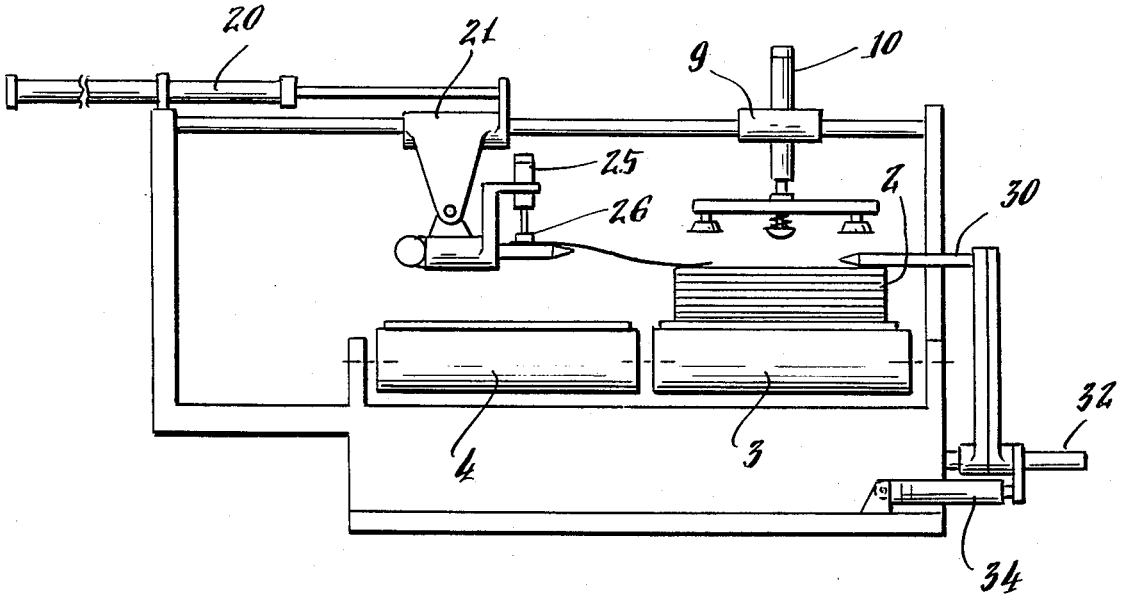
FIG. 6 is a lateral view of the system in operation while moving the released bag to the feeding device of the e bag inserting apparatus.

At this point, by means of a control supplied to piston 10, the suction cups 12 are lowered, grasp the bag and lift its central portion (see FIG. 3) in order to allow the bars 21 and 21' of the unsticking device 7, as well as the bars 30 and 30' of the unsticking device 8, to be inserted under the bag. This occurs because of the contemporaneous actuation of the pistons 20 and 33 respectively, as it can be seen also from FIG. 4. Then, as shown in FIGS. 3 and 5, in view of another control supplied to pistons 25, 25' and 34, 24', the bars 22, 22' of the device 7 and the corresponding bars 30, 30' of the device 8 are moved simultaneously from the close insertion position to the open unsticking position. In this latter position the arms 30 and 30' are pressing the bags underlying the bag being picked up, and the pads 26,26' (see FIG. 6) are pinching the edges of the bag on the bars 22, 22' always in the open position.

Under the action of piston 20, the device 7 returns to the starting position, stripping and finally separating the bag, and in its return stroke places on the conveyors belt 4 the bag picked up and separated from the pack. The system is therefore ready for another cycle of operation.

We claim:

1. System for picking up and separating bags from a pack for feeding them to an automatic bag inserting apparatus, comprising a lifting device for lifting transversally the uppermost bag of the pack, grasping said uppermost bag at its transversal central position, where said bag can never be glued to the next underlying bag, so as to allow to insert under said uppermost bag, from each side of said uppermost bag, at least first and second devices acting under said uppermost bag and causing said uppermost bag to be unstuck from said next underlying bag, the first device being coupled to means pinching, finally separating and transferring said bags one by one and sequentially, to feeding means of said bag inserting apparatus, the second device also providing for holding the underlying bags, during final unsticking and transfer of the bag picked up from the pack, said first device for unsticking and transferring said uppermost bag comprises a body adapted to slide on a guide parallel to the bag transversal middle portion which in the forward stroke brings the unsticking unit to act under the bag, and in the return stroke moves the bag on the means for feeding the bag inserting apparatus, the unsticking unit mounted on said body comprising two bars adapted to assume a first close position for insertion under the bag, and a second open position for unsticking the bag, said two positions being obtained by causing said bars to slide along a bar transversal to the movement of said device, by means of two pistons, said first device also including a picking and transfer unit comprising two vertically movable pads by means of two pistons pinching the bag edges against said unsticking bars when they are in the open position and transfer it, during the return stroke, on the feeding means for the bag inserting apparatus, during the return stroke said unit stripping and finally separating the uppermost bag from the next underlying bag of the pack.

2. System according to claim 1, wherein the lifting device comprises a horizontal support fixed on a guide, on which suction cups are mounted, supported by a piston having a vertical reciprocating motion, so that the suction cups grasp the side edges of the bag and lift them for a length adapted to allow insertion under it of the unsticking device, said horizontal support being provided at the central portion of the bag with a pusher which under the action of a spring holds down the bag at its central portion.

3. System according to claim 1, wherein the second unsticking device comprises two bars adapted to slide horizontally and assume, swinging around the foot of corresponding support arms, a close position of insertion under the bag and an open unsticking position, said positions being obtained by means of two pistons, and in the open position the bars having also the function of pushers on the bags underlying that being picked up, so as to hold down the underlying bags during the final separation and transfer of the bag being picked up.

* * * * *